United States Patent [19]

Harris

[11] Patent Number: 4,707,947

[45] Date of Patent: Nov. 24, 1987

[54] SHARPENING STONE FOR USE WITH A SABRE OR JIG SAW

[76] Inventor: Robert L. Harris, 2704 Broadmoor, Bryan, Tex. 77802

[21] Appl. No.: 888,710

[22] Filed: Jul. 23, 1986

[51] Int. Cl.[4] ..... B24B 23/04

[52] U.S. Cl. ..... 51/181 R; 51/170 TL; 76/82.1

[58] Field of Search ..... 51/181 R, 170 TL, 170 R; 76/82.1, 82; D8/70, 90

[56] References Cited

U.S. PATENT DOCUMENTS

| | | | |
|---|---|---|---|
| 2,197,626 | 4/1940 | Von Suheven | 51/170 TL |
| 2,210,733 | 8/1940 | Schmid et al. | 51/170 TL |
| 2,993,312 | 7/1961 | Holland et al. | 51/210 |
| 3,686,799 | 8/1972 | Doty | 51/181 R |
| 3,867,747 | 2/1975 | Lee | D8/90 |
| 3,914,906 | 10/1975 | Barnes | 51/170 TL |
| 3,925,867 | 12/1975 | Kareman | 29/78 |
| 4,365,397 | 12/1982 | Felpel | 29/76 R |

*Primary Examiner*—Roscoe V. Parker
*Attorney, Agent, or Firm*—Neal J. Mosely

[57] ABSTRACT

The sharpening stone is readily attachable in a chuck of an electrically powered sabre or jig saw. The sharpening stone is secured to a metal device (shaped to fit the saw chuck) by adhesive bonding or molded into the stone. The sharpener is especially effective for sharpening hand tools including power rotary lawn mower blades.

3 Claims, 4 Drawing Figures

SHARPENING STONE FOR USE WITH A SABRE OR JIG SAW

REFERENCES CITED

UNITED STATES PATENTS

U.S. Pat. No. 3,925,867, 2/4/75, Kareman, 29/76A
U.S. Pat. No. 3,867,747, 2/22/74, Lee, 29/76A
U.S. Pat. No. 4,365,397, 12/28/82, Felpel, 29/76R
U.S. Pat. No. 2,993,312, 11/7/57, Holland & Klatt, 51/210

PUBLICATIONS

"Grinding technology" Delmar Publisher, Albany, N.Y., 269 pp (1974), Krar and Oswald.
"Home and workshop guide to sharpening" Harper and Row, New York, 160 pp (1967), Walton.

BACKGROUND OF INVENTION

This invention relates generally to sharpening devices.

Many home, farm, and industrial tools must be sharpened frequently to insure proper operation. Portable sharpeners are usually limited to hand held files or stones and rotary stones attached to portable power drills. An effective sharpening stone that can be attached to a variable speed sabre or jig saw will provide an effective safe power driven sharpener for home, farm, and industrial uses.

SUMMARY OF INVENTION

The present invention's principal object is to provide a sharpener that uses a variable speed sabre or jig saw as a power source.

Another object is to provide a portable power driven stone sharpener that is more accurate and easier to control than the commonly used rotary type attached to a drill.

Another object is to provide a stone sharpener that is faster and easier to use than a hand held stone or file.

Another object is to provide a power stone sharpener that is safer to use than the rotary type attached to a drill.

BRIEF DESCRIPTION OF THE DRAWINGS

The design and how the device accomplishes these objects will be clear after reviewing the figures.

PREFERRED EMBODIMENT OF THE INVENTION

Figure 1:
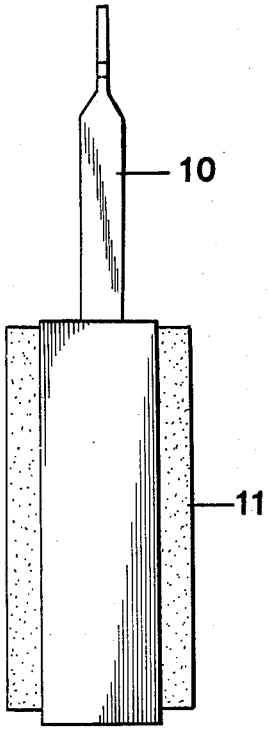
FIG. 1 Front view of the sharpening stone attached to the metal holding device which fits into a sabre or jig saw chuck.
Figure 2:
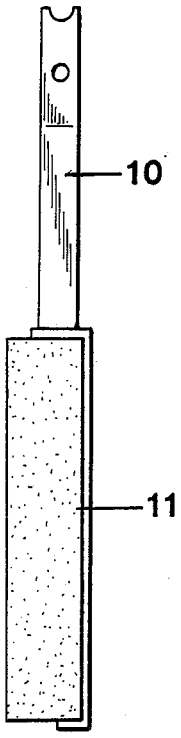
FIG. 2 Side view of the sharpening stone and attachment device.
Figure 4:
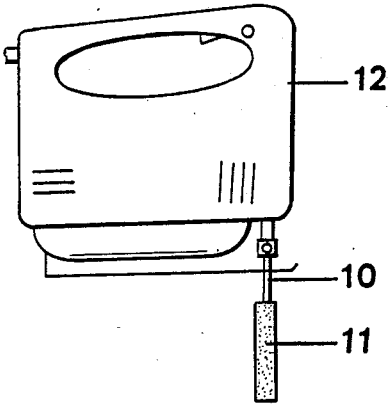
FIG. 4 Sharpening stone attached to an electrically driven jig saw.

Referring to the drawings the metal attachment device FIGS. 1 and 2 (part 10) is made of an appropriate steel alloy. This part consists of a flat metal sheet (about 3/32" thick and ¾" wide) so bent to fit one side and a fraction of both ends of a rectangular sharpening stone (part 11). A ¼" round or square rod is welded to or molded as a part of the metal sheet and is about 2" long. The distal end (about ½") is flattened and shaped to ¼" by 5/64" so as to fit the chuck of a sabre or jig saw (FIG. 4, No. 12). The attachment device 10 has the supporting portion for the stone 11 in a position 90° from the flattened distal end which fits the chuck of a jig saw or saber saw.

The sharpening stone (aluminum oxide, silicon carbide or other abrasive material of various abrasive grain sizes) is attached to the holding device by suitable bonding. The stone 11 is bonded to the attachment device 10 facing 90° from the flattened distal end which fits the saw chuck.

Figure 3:
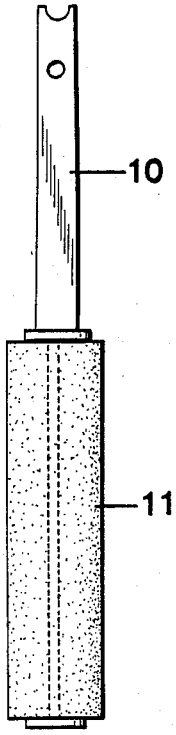
FIG. 3 Metal attachment device molded into the sharpening stone.

The additional attachment method (FIG. 3) is the same as described except the metal is molded in the center of the stone in order to provide a sharpening surface on four sides or the use of various shaped sharpening stones. Another exception is that the width and size of the metal part bonded in the stone will vary with the shape and size of the sharpening stone.

Thus the improved sharpening stone is provided for use with a variable speed sabre or jig saw. The reciprocating action of the saw moves the stone across the tool being sharpened similar to the action of a hand held file or stone.

A test was conducted to compare this new power driven stone sharpener to hand operated files and stones for sharpening shovels, hoes, hedge clippers, lawn snips, axes, and rotary lawn mower blades and it was found to be faster and easier to use than the hand powered sharpener. For example the hoe required four minutes to sharpen using a hand file and one and a half minutes using the sharpening stone power by a jig saw. Another example a shovel required 5 minutes to sharpen with a file and 3 minutes with the jig saw powered stone.

Another test was conducted to compare this sabre or jig saw powered stone sharpener to a rotary stone sharpener attached to an electric drill for sharpening rotary lawn mower blades and it was found to be more accurate, easier to control, generally safer and gave a more uniform sharpening than the rotary stone sharpener. The rotary stone sharpener will sling broken pieces of the stone or tool being sharpened by centrifugal force (2500+RPM) resulting in potential injury to the head of the operator. The sabre or jig saw driven sharpening stone travels only ¾" per stroke and is operating at no more than 3200 strokes per minute. The sabre or jig saw acts as a shield as only broken pieces directed toward the operator would be on the back stroke therefore they would strike the saw.

I claim:

1. In combination with a reciprocating saw motor having a reciprocating shaft operatively connected thereto and a chuck fixed to said shaft and adapted to receive the end of a saw blade, said chuck being provided with retaining means for retaining the end of a saw blade in said shaft;

a supporting member comprising a rigid rod portion having a flattened distal end shaped to fit said blade-receiving chuck, a rigid extension integral with said rigid rod portion including supporting means extending at a 90° angle to said flattened distal end, and an elongated rigid sharpening stone of abrasive material secured on said rigid supporting member extension by said supporting means at a 90° angle to said flattened distal end, said sharpening stone being operable to be reciprocated by said saw motor for sharpening tools and instruments.

2. A combination with a saw motor according to claim 1 in which said rigid extension comprises a yoke for supporting said sharpening stone, said sharpening stone being secured in the trough of said yoke.

3. A combination with a saw motor according to claim 1 in which said rigid extension comprises a flat extension from said rigid rod portion having longitudinally spaced flanges defining a yoke for supporting said sharpening stone, said sharpening stone being secured in the trough of said yoke.

* * * * *